US010618272B2

(12) United States Patent
Chung

(10) Patent No.: US 10,618,272 B2
(45) Date of Patent: Apr. 14, 2020

(54) TRANSFER DYEING METHOD

(71) Applicants: Newtech Textile Technology Development (Shanghai) Co., LTD, Shanghai (CN); Po-Wen Chung, Shanghai (CN)

(72) Inventor: Po-Wen Chung, Shanghai (CN)

(73) Assignees: NEWTECH TEXTILE TECHNOLOGY DEVELOPMENT (SHANGHAI) CO., LTD, Shanghai (CN); Po-Wen Chung, Shanghai (CN)

( * ) Notice: Subject to any disclaimer, the term of this patent is extended or adjusted under 35 U.S.C. 154(b) by 0 days.

(21) Appl. No.: 16/326,261

(22) PCT Filed: May 11, 2017

(86) PCT No.: PCT/CN2017/083967
§ 371 (c)(1),
(2) Date: Feb. 18, 2019

(87) PCT Pub. No.: WO2018/133258
PCT Pub. Date: Jul. 26, 2018

(65) Prior Publication Data

US 2019/0217600 A1 Jul. 18, 2019

(30) Foreign Application Priority Data

Jan. 23, 2017 (CN) ..... 2017 1 0048417

(51) Int. Cl.
*D06P 5/00* (2006.01)
*B41F 16/02* (2006.01)
(Continued)

(52) U.S. Cl.
CPC ..... *B41F 16/02* (2013.01); *B41F 31/00* (2013.01); *D06P 1/46* (2013.01); *D06P 5/002* (2013.01); *D06P 5/003* (2013.01); *D06P 5/007* (2013.01)

(58) Field of Classification Search
CPC .. D06P 5/003; D06P 5/007; D06P 5/30; D06P 5/00; D06P 1/46; D06P 5/002;
(Continued)

(56) References Cited

U.S. PATENT DOCUMENTS 4,138,945 A 2/1979 Rejto
5,339,731 A 8/1994 Howard et al.

FOREIGN PATENT DOCUMENTS

CN 1915682 A 2/2007
CN 102505525 A 6/2012
(Continued)

OTHER PUBLICATIONS

International Search Report issued in application No. PCT/CN2017/083967.

*Primary Examiner* — Eisa B Elhilo
(74) *Attorney, Agent, or Firm* — McClure, Qualey & Rodack, LLP

(57) ABSTRACT

A transfer dyeing method, includes: 1) coating a pretreating liquid on a front side of a fabric by a first pretreating anilox roller; 2) printing a dyeing ink on a first ink transfer roller or ink transfer ribbon by a first full-master printing plate roller; 3) transferring the dyeing ink to the front of the fabric; 4) drying the fabric and then making a back side of the fabric face to a second pretreating anilox roller; 5) coating the pretreating liquid on the back side of the fabric; 6) printing a dyeing ink that is same as or different from the dyeing ink of step 2) on a second transfer-roller or ink transfer ribbon; 7) transferring the dyeing ink to the back side of the fabric;
(Continued)

and 8) drying the fabric, followed by color fixing, water washing and shaping.

20 Claims, 6 Drawing Sheets

(51) Int. Cl.
*B41F 31/00* (2006.01)
*D06P 5/24* (2006.01)
*D06P 1/46* (2006.01)

(58) Field of Classification Search
CPC .... B41F 17/003; B41F 16/0046; B41F 17/00; B41F 17/38; B41F 16/0026; B41F 16/0073; B41F 15/46; B41F 16/0006; B41F 31/00; B41F 16/02
See application file for complete search history.

(56) References Cited

FOREIGN PATENT DOCUMENTS

| | | | | | |
|---|---|---|---|---|---|
| CN | 102785495 | A | | 11/2012 | |
| CN | 105058968 | A | * | 11/2015 | ..... B41F 15/08 |
| CN | 105150673 | A | | 12/2015 | |
| DE | 2 250 940 | A1 | | 5/1974 | |
| JP | 6-206305 | A | | 7/1994 | |
| WO | WO2013/086929 | A1 | * | 6/2013 | ..... D06P 5/003 |

* cited by examiner

TRANSFER DYEING METHOD

BACKGROUND

Technical Field

The present invention relates to printing and dyeing technologies in the textile industry, and specifically to a transfer dyeing method.

Related Art

While textile technologies are invented, dyeing technologies are also developed. As early as 15,000 years ago, primitive people began to dye fabrics with red iron oxide mineral pigments. In 1450, the dyeing industry in Europe has begun to take shape, and the dyeing process and use of dyes were got to known. In 1471, the dyeing practitioners from all over Europe gathered in London, England, to discuss issues related to dyeing process, and passed the first constitution to establish the Association of Dyeing Industry. After the Second World War, with the continuous development of the textile industry, the development of the dye industry was promoted. A peak was reached in the 1980s. The synthetic dyes could be subdivided into thirty-two types according to the chemical structures. If classified according to the application, they can be divided into eighteen categories, and there are up to tens of thousands of dyes. Each type of dyes is further divided into many groups according to different dyeing properties and process conditions. The same fiber can often be dyed with several dyes, and the same dye can also be used for the dyeing and printing of several different fibers. The dyeing mechanism and dyeing process applied in dyeing and printing are designed depending on the actual situation. In the 1990s, with the rising awareness of environmental protection and health care in countries around the world, a lot of regulations concerning environmental protection in printing and dyeing industry were formulated, which caused many dyeing factories to face the challenge of research and development. In recent years, during the use of dyes, old dyeing and printing technologies are gradually being eliminated. The market and society require the printing and dyeing enterprises to introduce new science and technologies, information process technologies and new processes into the production process of textile printing and dyeing from the perspective of energy saving, environmental protection, cost control, efficiency improvement, quality improvement and other socially closely related aspects.

Dyeing is a process in which the dye is physically or chemically bound to the fiber, or a pigment is chemically formed on the fiber to impart a certain color to the entire textile. Dyeing is carried out for a time at a certain temperature and pH in the presence of a desired dyeing aid. The dyed products should have a uniform color and good dye fastness. The existing dyeing methods of fabrics mainly include dip dyeing and pad dyeing. Dip dyeing is a method in which the fabric is immersed in a dyeing solution to dye the fabric with the dye gradually. It is suitable for the dyeing of multiple varieties in small batches. Long chain dyeing and jig dyeing both fall within this scope. Pad dyeing is a dyeing method in which a fabric is first immersed in a dyeing solution, and then the fabric is passed through a roller to uniformly roll the dyeing solution into the fabric, followed by steaming or hot melting. The method is suitable for dyeing of large quantities of fabrics. The traditional process of dyeing fibers can be described as follows. First, the dye reaches to the vicinity the fiber with the flow of the dye bath; secondly, the dye diffuses by its own thermal motion, passes through the liquid layer around the fiber and approaches the surface of the fiber; then the dye is absorbed by the fiber due to various forces between molecules, and the concentration of dye bath around the fiber is reduced; and finally, the dye diffuses to the interior of the fiber in the amorphous region of the fiber and is adsorbed. The dye bath method is actually an extensive production method, in which a large amount of water is consumed during the production process, and a large amount of dye-containing colored wastewater is produced after water washing. In China, the dyeing of 1 ton of textiles consumes 100 to 200 tons of water, of which 80 to 90% become waste water. Dyeing industry is one of the major wastewater discharging industries. Printing and dyeing wastewater is generally characterized by high pollutant concentration, many kinds of pollutants, large alkalinity, highly variable water quality, high COD content, presence of toxic and harmful components and high chromaticity, thus being one of the industrial wastewater that is difficult to treat. With the development of society and the improvement of the quality of personal and family life, the people's requirement for environmental protection and health becomes increasingly higher. The extensive traditional dyeing methods are on the list of outdated production capacity. For example, nearly half of the printing and dyeing factories have been shut down in Shaoxing, Zhejiang in 2016. However, the demand for dyed fabric products is still huge, so there is an urgent need in the market for developing and promoting a fabric dyeing process that is environmentally friendly, requires low water consumption, causes low discharge, and has high dyeing quality. Comparatively, the water consumption of printing is much lower than that of traditional dyeing. In fact, printing is a kind of local dyeing. During dyeing (especially dip dyeing), the fabric experiences a longer time of action in the dye bath, which allows the dye to diffuse more adequately and penetrate into the fiber to complete the dyeing process. During printing, after the paste added in the color paste is dried to form a film, the polymer film layer prevents the dye from diffusing into the interior of the fiber, so that the dye adheres to the surface of the fiber, and the dye is finally fixed by steaming, baking and other means. Therefore, dyeing by printing is one of the directions to achieve energy saving and emission reduction.

SUMMARY

In view of the disadvantages of high water consumption and large production of waste water existing in the dyeing process such as dip dyeing and pad dyeing, the present invention provides a transfer dyeing method, to overcome the shortcomings in the existing dyeing process and improve the quality of dyeing.

The transfer dyeing method includes the steps of:

1) uniformly coating a pretreating liquid on a front side of a fabric by a first pretreating anilox roller, to form a fabric having a front side with a wet surface layer for ease of color fixing in a subsequent procedure;

2) printing a dyeing ink on a first ink transfer roller or ink transfer ribbon by a first full-master printing plate roller;

3) pressing the fabric having a front side with a wet surface layer obtained in Step 1 tightly to the first ink transfer roller or ink transfer ribbon obtained in Step 2, to allow them to be in contact with each other under pressure, and transfer the dyeing ink from the first ink transfer roller/ink transfer ribbon to the front side of the fabric, so as to realize dyeing on the front side of the fabric 4) drying the fabric and then making a back side of the fabric face to a second pretreating anilox roller;

5) then uniformly coating the pretreating liquid on the back side of the fabric by the second pretreating anilox roller, to form a fabric having a back side with a wet surface layer;

6) printing a dyeing ink that is the same as or different from the dyeing ink in Step 2 on a second ink transfer roller or ink transfer ribbon by a second full-master printing plate roller, according to the dyeing requirement of the double-sided same color or double-sided different colors;

7) pressing the fabric having a back side with a wet surface layer obtained in Step 5 tightly to the second ink transfer roller or ink transfer ribbon obtained in Step 6, to allow them to be in contact with each other under pressure, and transfer the dye ink from the second ink transfer roller/ink transfer ribbon to the back side of the fabric, so as to realize dyeing on the back side of the fabric; and 8) drying the fabric, followed by color fixing, water washing and shaping, to obtain a dyed end product.

The formulation of the pretreating liquid in Step 1 includes, in weight percentages:

vehicle, 2-10%;

surfactant, 1-3%;

leveling agent, 1-4%;

dye fixing agent, 0-25%;

pH adjusting agent, 0-2%; and deionized water, q.s. to 100%.

The vehicle is sodium alginate, guar gum, synthetic gum tragacanth, cellulose and a derivative thereof, starch and a derivative thereof, or a polymer of acrylic acid, butenoic acid and a derivative thereof.

The surfactant is polyvinylpyrrolidone, polyoxyethylene alkylamines, fatty alcohol-polyoxyethylene ethers, or polysiloxane.

The leveling agent is sodium alkyl sulfonate, sodium higher fatty alcohol sulfate, or fatty alcohol-polyoxyethylene.

The dye fixing agent in the pretreating liquid for active dyeing inks is sodium carbonate, sodium bicarbonate, sodium hydroxide, potassium carbonate, potassium bicarbonate, potassium hydroxide, or substitute alkali; the dye fixing agent in the pretreating liquid for acid dyeing inks is urea, or dicyandiamide; and no dye fixing agent is added in the dye fixing agent in the pretreating liquid for disperse dyeing inks.

The pH adjusting agent is citric acid, acetic acid, ammonium sulfate, or triethanol amine.

The anilox roller in Step 1 is a laser engraved chromium-plated anilox roller or ceramic anilox roller having a line number of 60-200 lines/cm.

The dyeing ink is one disclosed in the art.

The plate roller is a gravure plate roller, a flexographic plate roller, a rotary screen or an offset plate roller.

The ink transfer roller or ink transfer ribbon has a surface made of a rubber coating with a thickness of 3-15 mm and a surface hardness of 45-90 Shore degrees, where the rubber is polyurethane rubber, acrylonitrile-butadiene rubber, neoprene rubber, chlorosulfonated polyethylene rubber, or ethylene-propylene rubber.

The color fixing in Step 8 is cold dome color fixing, steaming fixation, or baking fixation.

Optionally, Steps 2 and 3 are performed in a dyeing unit of a dyeing apparatus. The dyeing unit includes: a central roller mounted on a frame; and at least one dyeing deployment device arranged around the circumference of the central roller, where a fabric to be dyed enters and is dyed between the central roller and each dyeing deployment device. Each dyeing deployment device includes the full-master printing plate roller carrying full master of dyeing ink and the ink transfer roller for transferring the dyeing ink on the full-master printing plate roller to the fabric, and the ink transfer roller is located between the full-master printing plate roller and the central roller.

Steps 6 and 7 are also performed in a dyeing unit of a dyeing apparatus. The dyeing unit includes: a central roller mounted on a frame; and at least one dyeing deployment device arranged around the circumference of the central roller, where a fabric to be dyed enters and is dyed between the central roller and each dyeing deployment device. Each dyeing deployment device includes the full-master printing plate roller carrying full master of dyeing ink and the ink transfer roller for transferring the dyeing ink on the full-master printing plate roller to the fabric, and the ink transfer roller is located between the full-master printing plate roller and the central roller.

Optionally, the outer diameter of the printing plate roller<the outer diameter of the ink transfer roller≤the outer diameter of the printing plate roller+1 mm.

Optionally, each dyeing deployment device further includes a pressure applicator member configured to adjustably provide a pressure with which the ink transfer roller presses against the printing plate roller. The pressure applicator member is capable of selectively moving the ink transfer roller to a pressing position and a rest position. At the pressing position, the ink transfer roller presses against the printing plate roller to generate a pressure with which the transfer roller presses against the printing plate roller; and at the rest position, the ink transfer roller does not press against the printing plate roller.

Optionally, the pressure applicator member includes a rotatable eccentric bushing. A shaft end of the ink transfer roller is rotatably mounted in the eccentric bushing, and the distance between the ink transfer roller and the printing plate roller is capable of being adjusted by rotating the eccentric bushing, thereby adjusting the generated pressure with which the ink transfer roller presses against the printing plate roller.

Optionally, the ink transfer roller is selectively moved to multiple pressing positions by rotating the eccentric bushing.

Optionally, the pressure applicator member further includes a connecting rod for driving the eccentric bushing to rotate and a swing arm for moving the connecting rod. One end of the connecting rod is connected to the eccentric bushing, the other end of the connecting rod is connected to the swing arm. The swing arm is pivotable relative to the body of the dyeing deployment device by means of a swing arm pivot shaft.

Optionally, the pressure applicator member further includes an actuator. The actuator drives the swing arm to pivot, and the pivoting of the swing arm causes the connecting rode to drive the eccentric bushing to rotate, thereby moving the ink transfer roller to the pressing position or the rest position.

Optionally, one pressure applicator member is provided on each of the two shaft end sides of the ink transfer roller.

Optionally, one pressure applicator member is provided on each of the two shaft end sides of the ink transfer roller, and the swing arm on one shaft end side and the swing arm on the other shaft end side are pivoted synchronously by the same swing arm pivot shaft, to achieve the synchronous movement of the two connecting rods and eccentric bushings, thereby maintaining the synchronous pressure application on the two shaft ends of the printing plate roller.

Optionally, only one of the pressure applicator members on the two shaft end side of the ink transfer roller includes an actuator for driving the swing arm to pivot.

Optionally, the swing arm includes a first arm portion and a second arm portion, and each arm portion includes a first end and a second end. The first end of the first arm portion is pivotally coupled to a protrusion of the actuator by a pin, the first end of the second arm portion is pivotally coupled to the other end of the connecting rod by a pin, and the second ends of the two arm portions are non-rotatably fixed to the end portion of the swing arm pivot shaft.

Optionally, the swing arm includes a first arm portion and a second arm portion, and each arm portion includes a first end and a second end. The first end of the first arm portion is pivotally coupled to a protrusion of the actuator by a pin, the first end of the second arm portion is pivotally coupled to the other end of the connecting rod by a pin, and the second ends of the two arm portions are non-rotatably fixed to the end portion of the swing arm pivot shaft.

Optionally, the central roller is a roller of hard material having a surface covered with a rubber and a cavity filled with an oil. The roller of hard material controls the temperature of the central roller by heating the oil by an electrical heating bar provided in the cavity.

Optionally, each dyeing deployment device further includes a propulsion device for providing a propulsive force for advancing the ink transfer roller toward the central roller, and the propulsion device is mounted on a frame of the dyeing deployment device.

Optionally, each dyeing deployment device is capable of independently advancing toward or going away from the central roller by means of respective propulsion device.

Optionally, the propulsion device also provides an independently adjustable pressure that allows the ink transfer roller to press against the fabric to be dyed on the central roller.

Optionally, each dyeing deployment device further includes a frame in which a mounting block is disposed, where the ink transfer roller and the printing plate roller are rotatably mounted into the mounting block, and the mounting block is capable of moving in the frame towards the central roller with the propulsion of the propulsion device.

Optionally, a slide rail is provided in the frame, and the mounting block is slidable on the slide rail.

Optionally, the axes of the ink transfer roller, the printing plate roller, and the central roller are parallel to each other, but are not coplanar.

Optionally, each dyeing deployment device further includes a pressure locker for locking the pressure between the ink transfer roller and the printing plate roller.

The present invention has the following beneficial effects. Instead of the traditional dip dyeing or pad dyeing, a transfer dyeing method is adopted, so that only the surface of a fabric is dyed, and the interior and the non-visible portion of the fabric are not filled with dye, whereby the amount of dye and water consumption are greatly saved. Required amount of dye is loaded, and the amount of dye is appropriate; and the fixation rate is high, so the water consumption of the washing procedure is low, and less wastewater is produced. Rather than a mode in which a dye fixing agent and a dye are simultaneously loaded in the same slurry in a traditional dyeing method, a mode including treatment with a pretreating liquid, then dyeing and dye fixation is employed, to ensure the storage stability of the dyeing ink. In the present invention, single-sided dyeing, double-sided dyeing, single-color dyeing, or double-sided different-color dyeing can be achieved, thus satisfying the market demand for differentiation of dyed fabrics.

BRIEF DESCRIPTION OF THE DRAWINGS

Hereinafter, the present invention is further described with reference to drawings and embodiments.

DETAILED DESCRIPTION

The present invention is further illustrated by the following non-limiting embodiments, but it should be noted that these embodiments are not to be construed as limiting the invention.

Embodiment 1: Double-Sided Different-Color Transfer Dyeing of All-Cotton Fabric Fabric specification: 100% cotton, knitted, 150 g/m$^2$.

A double-sided different color transfer dyeing method of all-cotton fabric includes the steps of:

1) uniformly coating a pretreating liquid on a front side of a fabric by a first anilox roller, to form an all-cotton fabric having a front side with a wet surface layer;

2) printing a front-side color providing dyeing ink on an ink transfer roller by a first full-master printing plate roller;

3) pressing the fabric having a front side with a wet surface layer obtained in Step 1 tightly to the ink transfer roller obtained in Step 2, to allow them to be in contact with each other under pressure, and transfer the dyeing ink from the ink transfer roller to the front side of the all-cotton fabric, so as to realize dyeing on the front side of the all-cotton fabric;

4) drying the all-cotton fabric, and then making the back side of the all-cotton fabric face to a second pretreating anilox roller;

5) then uniformly coating the pretreating liquid on the back side of the all-cotton fabric by the second anilox roller, to form an all-cotton fabric having a back side with a wet surface layer;

6) printing a back-side color providing dye ink on another ink transfer roller by a second full-master printing plate roller;

7) pressing the all-cotton fabric having a back side with a wet surface layer obtained in Step 5 tightly to the ink transfer roller obtained in Step 6, to allow them to be in contact with each other under pressure, and transfer the dyeing ink from the ink transfer roller to the back side of the fabric, so as to realize dyeing on the back side of the all-cotton fabric; and 8) drying the fabric, followed by color fixing, water washing and shaping, to obtain a dyed end product.

Figure 1:
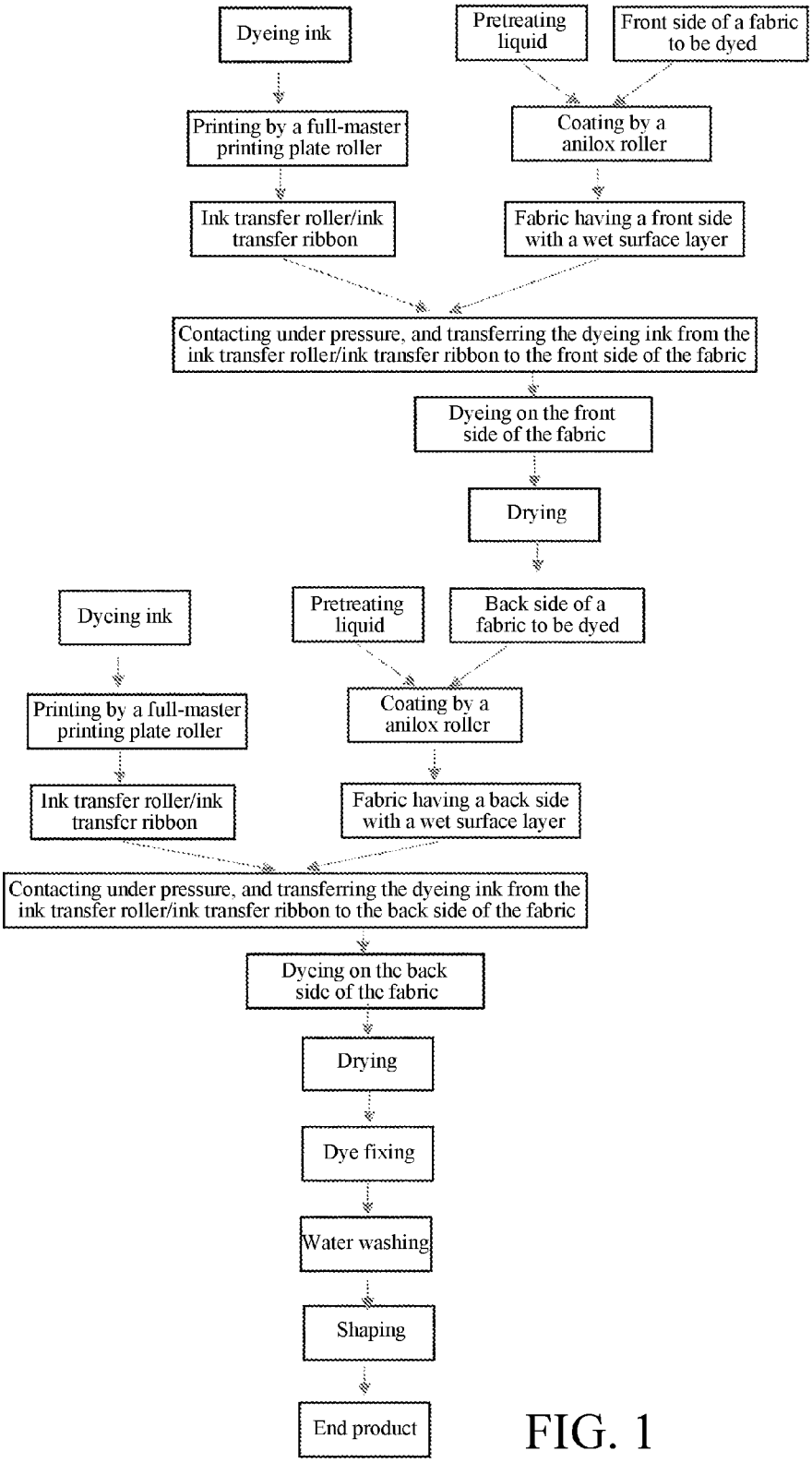
FIG. 1 is a flow chart of a transfer dyeing method according to an embodiment of the present invention.

FIG. 1 shows a flow chart of Embodiment 1.

The first anilox roller and the second anilox roller may be the same roller or two different rollers. The formulation of the pretreating liquid includes, in weight percentages:

vehicle, 0%;
surfactant, 2%;
leveling agent, 4%;
dye fixing agent, 25%;
pH adjusting agent, 0%; and
deionized water, q.s. to 100%.

The vehicle is sodium alginate.

The surfactant is a polyoxyethylene alkylamine.

The leveling agent is a sodium higher fatty alcohol sulfate.

The dye fixing agent is an alkaline agent obtained by mixing sodium bicarbonate, sodium carbonate, and potassium carbonate at a weight ratio of 1:4:2.

The anilox roller is a laser engraved ceramic anilox roller having a line number of 60 lines/cm.

The dyeing ink is an active dyeing ink disclosed in the art.

The full-master printing plate roller is a gravure plate roller.

The ink transfer roller has a surface made of a rubber coating with a thickness of 3 mm and a surface hardness of 90 Shore degrees, where the rubber is a polyurethane rubber.

The color fixing in Step 8 is cold dome color fixing at 25° C., for 6 hrs.

Embodiment 2: Double-Sided Same-Color Transfer Dyeing of Nylon Fabric

Fabric specification: Taslon; raw material: 100% Nylon, specification: 70D×160D

A double-sided same-color transfer dyeing method of a Nylon fabric includes the steps of:

1) uniformly coating a pretreating liquid on a front side of a fabric by a first anilox roller, to form a Nylon fabric having a front side with a wet surface layer;

2) printing a dyeing ink on an ink transfer ribbon by a first full-master printing plate roller;

3) pressing the Nylon fabric having a front side with a wet surface layer obtained in Step 1 tightly to the ink transfer ribbon obtained in Step 2, to allow them to be in contact with each other under pressure, and transfer the dyeing ink from the ink transfer ribbon to the front side of the Nylon fabric, so as to realize dyeing on the front side of the Nylon fabric;

4) drying the fabric, and then making the back side of the Nylon fabric face to a second pretreating anilox roller;

5) then uniformly coating the pretreating liquid on the back side of the Nylon fabric by the second anilox roller, to form an Nylon having a back side with a wet surface layer;

6) printing the same dyeing ink as that in Step 2 on another ink transfer ribbon by a second full-master printing plate roller;

7) pressing the Nylon fabric having a back side with a wet surface layer obtained in Step 5 tightly to the ink transfer ribbon obtained in Step 6, to allow them to be in contact with each other under pressure, and transfer the dyeing ink from the ink transfer ribbon to the back side of the fabric, so as to realize dyeing on the back side of the fabric; and 8) drying the fabric, followed by color fixing, water washing and shaping, to obtain a dyed end product.

The formulation of the pretreating liquid includes, in weight percentages:

vehicle, 2%;
surfactant, 3%;
leveling agent, 1%;
dye fixing agent, 3%;
pH adjusting agent, 2%; and
deionized water, q.s. to 100%.

The vehicle is sodium carboxymethyl cellulose.

The surfactant is a fatty alcohol-polyoxyethylene ether.

The leveling agent is a fatty alcohol-polyoxyethylene.

The dye fixing agent is an alkaline agent obtained by mixing urea and dicyanodiamide at a weight ratio of 2:1.

The pH adjusting agent is ammonium sulfate.

The anilox roller is a laser engraved chromium-plated anilox roller having a line number of 120 lines/cm.

The dyeing ink is an acid dyeing ink disclosed in the art.

The full-master printing plate roller is a flexographic plate roller.

The ink transfer ribbon has a surface made of a rubber coating with a thickness of 8 mm and a surface hardness of 75 Shore degrees, where the rubber is a butyronitrile rubber.

The color fixing in Step 8 is steaming fixation at 103° C. for 20 min.

Embodiment 3: Single-Sided Transfer Dyeing of Polyester Fabric

Fabric: polyester tabby; fabric specification: raw material polyester 111 dtex (DTY)×111 dtex (DTY), density: 256×256 yarns/10 cm, weight: 142 g/m2.

A single-sided transfer dyeing method of a polyester fabric includes the steps of:

uniformly coating a pretreating liquid on a front side of a fabric by an anilox roller, to form a polyester fabric having a front side with a wet surface layer;

printing a dyeing ink on an ink transfer roller by a full-master printing plate roller;

pressing the fabric having a front side with a wet surface layer obtained in Step 1 tightly to the ink transfer roller obtained in Step 2, to allow them to be in contact with each other under pressure, and transfer the dyeing ink from the ink transfer roller to the front side of the fabric, so as to realize dyeing on the front side of the polyester fabric; and drying the fabric, followed by color fixing, water washing and shaping, to obtain a dyed end product.

The formulation of the pretreating liquid in Step 1 includes, in weight percentages:

vehicle, 10%;
surfactant, 1%;
leveling agent, 3%;
dye fixing agent, 0%;
pH adjusting agent, 0%; and
deionized water, q.s. to 100%.

The vehicle is methyl methacrylate, butyl acrylate, and an acrylic terpolymer.

The surfactant is polyvinylpyrrolidone.

The leveling agent is sodium alkyl sulfonate.

The anilox roller in Step 1 is a laser engraved chromium-plated anilox roller having a line number of 200 lines/cm.

The dyeing ink in Step 2 is a disperse dyeing ink disclosed in the art.

The printing plate roller in Step 2 is an offset plate roller.

The ink transfer roller in Step 2 has a surface made of a rubber coating with a thickness of 15 mm and a surface hardness of 45 Shore degrees, where the rubber is a neoprene rubber.

The color fixing in Step 8 is baking fixation at 180° C. for 20 min.

Figure 2:
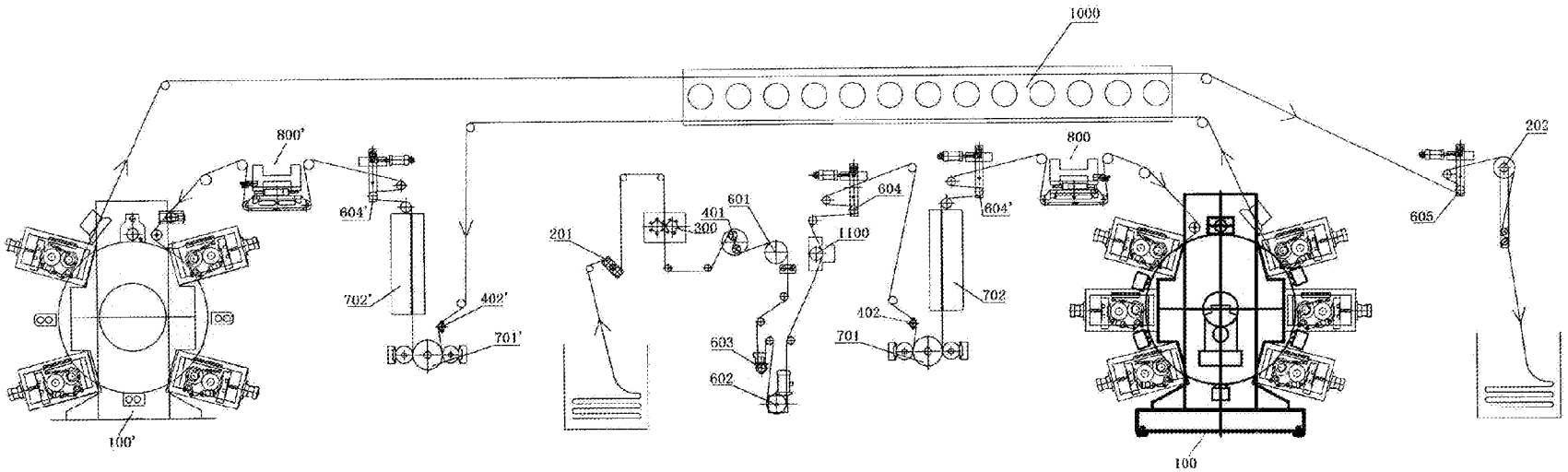
FIG. 2 is an overall schematic view of a transfer dyeing apparatus implementing this embodiment, with which double-sided dyeing can be performed.

For example, FIG. 2 shows a transfer dyeing apparatus implementing the transfer dyeing method described in Embodiment 1 of the present invention. During dyeing, the fabric travels through the following parts of the transfer apparatus device in sequence: a cloth tightening stand 201; a dedusting unit 300; a double-roller active expanding device 401; a centering device 601; a tension controller 603; an active directing device 602; a corona treatment unit 1100; a first tension swing link device 604; a first presizing expanding device 402; a first sizing device 701 and a first dehumidifying device 702, configured to size and dehumidify the fabric before a first side of the fabric is dyed; a second tension swing link device 604; a first deviation correcting unit 800; a first dyeing unit 100, configured to dye the first side of the fabric; a drying unit 1000; a second presizing expanding device 402'; a second sizing device 701' and a second dehumidifying device 702', configured to size and dehumidify the fabric before a first side of the fabric opposing the first side is dyed; a third tension swing link device 604"; a second deviation correcting unit 800'; a second dyeing unit 100', configured to dye the second side of the fabric; a drying unit 1000; a tension swing arm device 605; and a falling cloth directing device 202.

The first dyeing unit 100 is configured to perform Steps 2 and 3 in Embodiment 1. The second dyeing unit 100' is configured to perform Steps 6 and 7. The second dyeing unit 100' has a structure similar to that of the first dyeing unit 100. For convenience of description, only the first dyeing unit 100 is described below, and is simply referred to as the dyeing unit 100.

The dyeing unit is a core of the whole dyeing apparatus and consists essentially of at least one dyeing deployment device 5 and a central roller 1, as will be described in further detail below. Each dyeing deployment device includes a full-master printing plate roller. In Embodiment 1, the full-master printing plate roller is a gravure plate roller, without limitation. The full-master printing plate roller may be an anilox roller (full-master gravure printing plate roller), a full-master flexographic printing plate roller, a full-master rotary screen printing plate roller or a full-master offset printing plate roller. The central roller and each dyeing deployment device are independently driven by an AC servomotor. A motion controller in a central control unit is connected to each AC servomotor through a high-speed field bus, thereby achieving the high-precision synchronous control of the central roller and each dyeing deployment device. The dyeing unit can realize the pre-registration function by adopting the AC servomotor and the motion controller, thus greatly reducing the waste of materials. The dyeing unit 100 includes at least one dyeing deployment device. When the dyeing is carried out by using a plurality of dyeing deployment devices of the same color, the multiple full-master superposition of the same color can ensure the uniformity of dyeing. As the number of dyeing deployment devices in operation that the fabric passes through increases, the color dyed will become deeper. The control of the intensity of color can be achieved by controlling the number of dyeing deployment devices in operation. For the dyeing of thick cloth or flannel fabric that requires the penetration of dyes, sufficient penetration of the dye can be achieved by means of multiple presses, or multiple presses of different pressure gradients, to ensure the dyeing effect.

Figure 3:
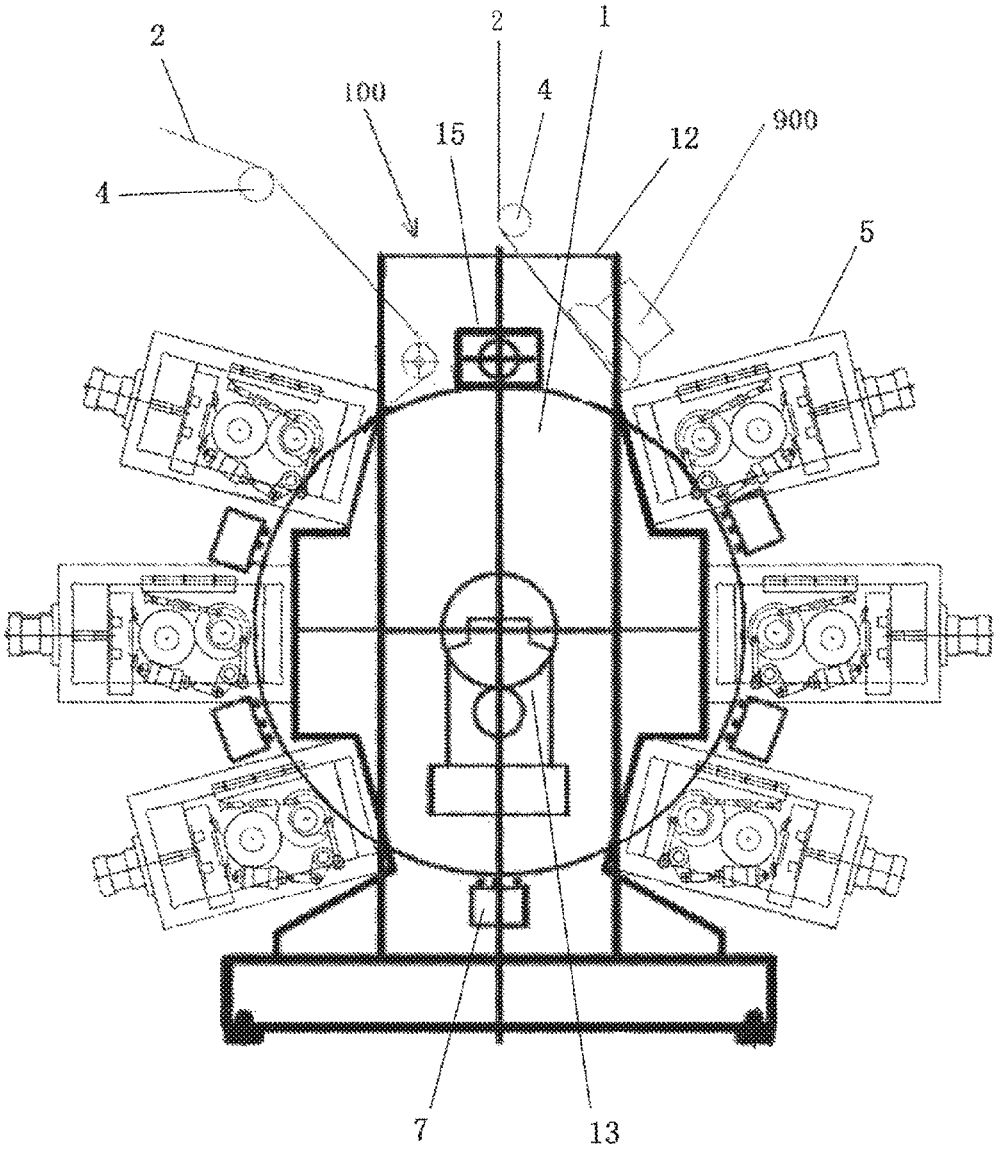
FIG. 3 is a schematic illustration of a dyeing unit of the transfer dyeing apparatus.
Figure 4:
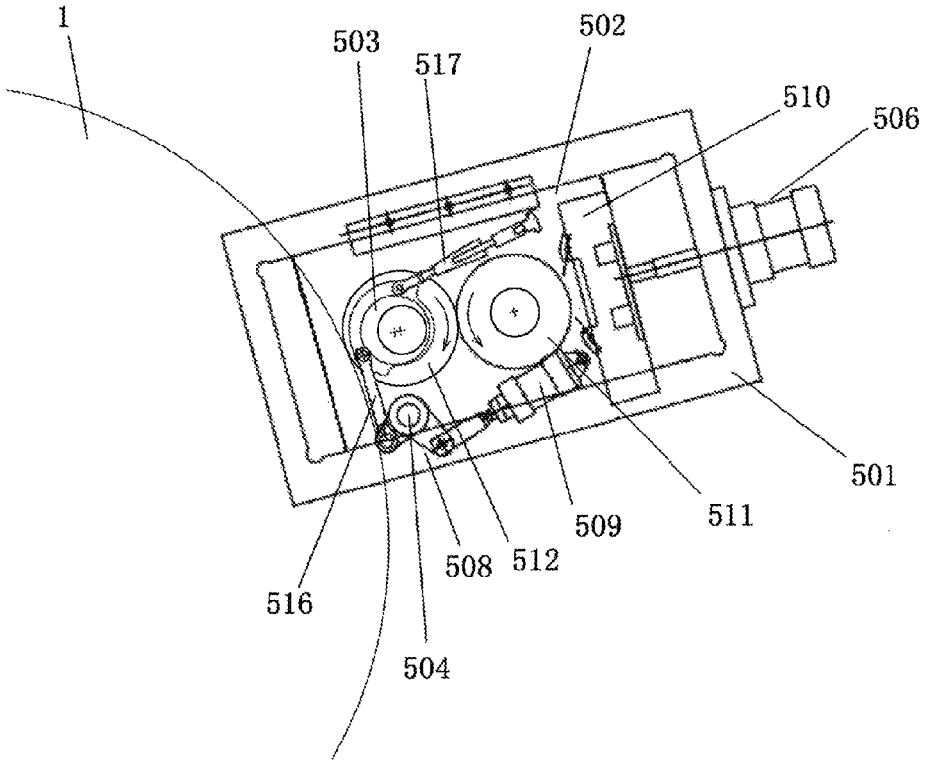
FIG. 4 is a schematic illustration of an individual dyeing deployment device of the dyeing unit.
Figure 5:
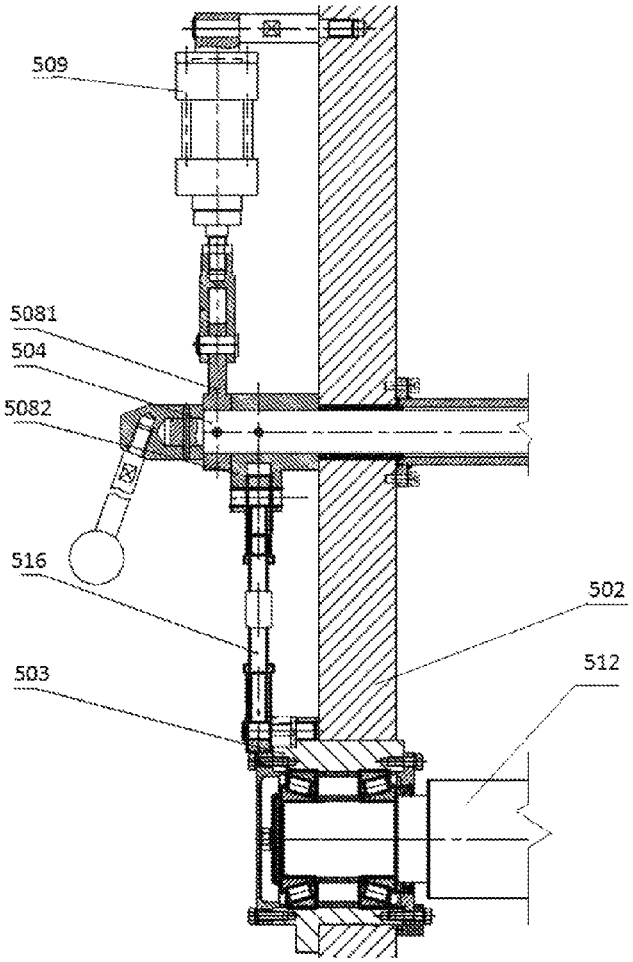
FIG. 5 is a cross-sectional view of the individual dyeing deployment device of the dyeing unit taken along the axial direction of an actuator, a swing arm, a connecting rod, an eccentric bushing, and other components.

Referring to FIGS. 3-5, the dyeing unit 100 will be described in further detail below. As described above, the dyeing unit 100 mainly includes a central roller 1 and at least one dyeing deployment device 5. The dyeing unit adopts a satellite structure, and the at least one dyeing deployment device shares one central roller as a back pressure roller.

The central roller 1 is fixedly attached to the frame 12 by a bearing. The central roller 1 can be driven to rotate by an inverter motor 13. The central roller 1 can be a roller of hard material having a surface covered with a rubber. The surface rubber has a Shore hardness of 85 to 90 degrees, and preferably 90 degrees. The outer diameter of the central roller 1 may be 1600-2000 mm, and preferably 1800 mm. Optionally, the central roller may have a cavity filled with an oil, and the temperature of the central roller 1 can be raised to 30-150° C. by heating the oil through an electrical heating bar provided in the cavity. Obviously, the temperature of the central roller can be otherwise controlled by those skilled in the art according to actual needs. The central roller can be warmed by heating to stabilize the transfer dyeing temperature, thus avoiding the unstable product quality between batches caused by large temperature differences due to seasonal or diurnal variations. For some high-count and high-density fabrics, the fabric fibers to be dyed can be further expanded by heating, thereby increasing the dye uptake rate and dyeing speed.

At least one (for example, 2-8, and 6 shown in FIG. 3) dyeing deployment device 5 is distributed around the circumference of the central roller 1. A propulsive force is provided to each dyeing deployment device 5 to advance toward the central roller 1 independently by respective propulsion device, such as a propulsion cylinder 506. The propulsion cylinder 506 is mounted on the body of each dyeing deployment device 5, for example, on a frame 501 of the body.

Alternatively, the transfer dyeing apparatus may further include a guide roller 4. More preferably, at least two guide rollers 4 are provided. At least one guide roller is disposed respectively in the vicinity of the inlet and the outlet where the fabric to be dyed is in contact with the central roller. The guide roller 4 guides the fabric 2 into or out of a pressurized section between the central roller 1 and the dyeing deployment device 5. Preferably, each guide roller 4 is a roller of hard material. Each guide roller has an outer diameter of 100-150 mm.

Optionally, a drying box 7 may be disposed between each of the dyeing deployment devices 5 to ensure that the ink is dried after printing, and the phenomenon of staining and color contamination between multiple registrations is prevented. In particular, referring to FIG. 3, five drying oven boxes 7 are provided which are distributed alternately with six dyeing deployment devices 5 around the circumference of the central roller 1.

Alternatively, the transfer dyeing apparatus according to the present invention may further include an online central roller cleaning system 15 disposed in a non-pressurized section between the central roller 1 and the dyeing deployment device 5. The online central roller cleaning system 15 includes a cleaning device, a water wiper blade and an oven. After the surface of the central roller 1 is cleaned by the cleaning device, the surface of the central roller 1 is wiped to remove water by the water wiper blade, and then dried in the oven to achieve continuous circulation application. The cleaning device can include a sprinkler and a brush.

FIGS. 4 and 5 show the dyeing deployment device 5 of the transfer dyeing apparatus according to an embodiment of the present invention. In the illustrated embodiment, the dyeing deployment device 5 may include the propulsion cylinder (for example, propulsion cylinder 506), an ink duct component 510, an anilox roller 511, an ink transfer roller 512 and a pressure applicator member. The ink duct component 510, the anilox roller 511, the ink transfer roller 512 and the pressure applicator member are mounted in the frame 501. The ink transfer roller 512 is located between the anilox roller 511 and the central roller 1 and can be in contact with the anilox roller 511. The respective shaft ends of the ink transfer roller 512 and the anilox roller 511 can be mounted into a mounting block 502 within the frame 501. The mounting block 502 is slidable on a slide rail disposed on the frame 501 such that under the action of the propulsion cylinder 506, the mounting block 502 moves toward the central roller 1 to allow the ink transfer roller 512 to reach a position where the ink transfer roller 512 is in contact with the fabric to be dyed on the central roller 1. Here, the propulsion cylinder 506 can also provide a pressure with which the ink transfer roller 512 presses against the fabric to be dyed on the central roller 1. According to an embodiment of the present invention, the pressure provided by each propulsion cylinder 500 to press the ink transfer roller 512 against the fabric to be dyed on the central roller 1 is independently adjustable. The pressure is adjusted by a control system, or is programmed to increase gradually, or programmed to decrease gradually. The entire dyeing deployment device 5 is pushed by the propulsion cylinder 506 along the straight slide rail to achieve the engagement to and disengagement from the central roller, where the traveling distance can be 2-5 cm.

The anilox roller 511 has a selectable outer diameter that is generally 95-200 mm. The anilox roller 511 is equipped with an ink duct component 510. An ink supply system delivers ink into an ink chamber formed between the ink duct component 510 and the anilox roller 511. The anilox roller 511 can be driven by a servomotor and synchronized with the anilox rollers 511 of other dyeing deployment devices 5 to ensure the registration accuracy.

Preferably, the ink transfer roller 512 can be a roller of hard material having a surface covered with a rubber. The surface can be covered with a seamless rubber. The rubber is natural rubber, styrene-butadiene rubber, polyurethane rubber or other rubbers with good affinity to aqueous ink. Preferably, the surface rubber of the ink transfer roller 512 has a Shore hardness of 85 to 90 degrees, and further preferably 90 degrees.

Since the ink transfer roller 512 of each dyeing deployment device is a rubber-covered roller of hard material, the outer diameter of the ink transfer roller 512 is slightly larger than that of the anilox roller 511, thus providing a certain tolerance space while ensuring the completeness of the transfer dyeing ink. During the transfer dyeing process, when the rubber ink transfer roller is in contact with the anilox roller, the rubber of the rubber ink transfer roller is deformed by the pressure from the propulsion of the propulsion device and the pressure of the pressure applicator member. When the current surface of the anilox roller is turned away from the rubber surface of the rubber ink transfer roller, the rubber surface can quickly return to its original shape. Preferably, the outer diameter of the anilox roller 511<the outer diameter of the ink transfer roller 512≤the outer diameter of the anilox roller 511+1 mm, that is, the outer diameter of the ink transfer roller 512 is larger than the outer diameter of the anilox roller 511, but the difference therebetween is 1 mm or less. The dyeing apparatus according to the invention has high pressure tolerance and high precision, and can completely carry the dyeing ink, thereby ensuring the registration accuracy of the dyeing ink after transfer. In addition, the compression deformation of the rubber is small, so that it can withstand thousands of times of compression per hour, without permanent deformation caused by compression fatigue during the production cycle.

The pressure applicator member can be used to provide an adjustable pressure with which the ink transfer roller 512 presses against the anilox roller 511. The pressure applicator member is used to adjust the amount of ink to control the chromatic aberration, and the pressure is mainly used to stick the ink out of the anilox roller cell. In the embodiment shown, the pressure applicator member includes an actuator 509 and an eccentric bushing 503. The actuator 509 includes a cylinder and a piston rod. The cylinder is pivotally coupled to the mounting block 502. The actuator 509 can be of a hydraulic type, a pneumatic type or an electric type. In the case where the actuator 509 is of a hydraulic or pneumatic type, the length of the piston rod extending can be adjusted by adjusting the fluid pressure in the chamber of the cylinder. Preferably, the actuator 509 can be a servoactuator, such as a servomotor cylinder.

The pressure applicator member may further include a swing arm 508 and a connecting rod 516 In the embodiment shown, the swing arm 508 is pivotally coupled to the mounting block 502 by a swing arm pivot shaft 504. The swing arm 508 includes a first end portion and a second end portion. The first end portion of the swing arm 508 is pivotally coupled to a protrusion of the piston rod of the actuator 509 via a pin. The second end portion of the swing arm 508 is pivotally coupled to one end of the connecting rod 516 by a pin. The other end of the connecting rod 516 is pivotally coupled to the eccentric bushing 503. Of course, it will be apparent to those skilled in the art that in addition to the swing arm-connecting rod pattern described herein, the rotation of the eccentric bushing 503 by the actuator 509 can be accomplished by means of any other transmissions. Optionally, a handle can be provided at the end portion of the swing arm pivot shaft to manually adjust the rotation of the eccentric bushing 503 by an operator during the commissioning phase.

In another embodiment according to the present invention, the swing arm 508 can include a first arm portion 5081 and a second arm portion 5082. Each arm portion includes a first end and a second end. The first end may be a small end, and the second end may be a large end. The first end of the first arm portion 5081 is pivotally coupled to the protrusion of the piston rod of the actuator 509 by a pin, and the first end of the second arm portion 5082 is pivotally coupled to one end of the connecting rod 516 by a pin. The second ends of the first arm portion 5081 and the second arm portion 5082 are both non-pivotablely coupled to the swing arm pivot shaft 504. For example, the second end may be provided with a pivot hole, and the swing arm pivot shaft is fixed to the pivot hole of the second end by the key-to-key-slot fit, the connection of a pin and a pin hole or the interference fit. The swing arm pivot shaft 504 is pivotally mounted to the mounting block 502. Preferably, the swing arm pivot shaft 504 extends axially outward from the mounting block 502 to form a protrusion. The protrusion can be used to connect the second ends of the first arm portion 5081 and the second arm portion 5082. The other end of the connecting rod 516 is pivotally coupled to the eccentric bushing 503 by a pin.

The eccentric bushing 503 is substantially sleeve-shaped as a whole, but the central axis of the outer cylindrical surface is not collinear with the central axis of the inner cylindrical surface, that is, the two are offset by a certain distance. The eccentric bushing 503 is rotatably mounted in a bushing hole of the mounting block 502. In the embodiment shown, the outer diameter of the eccentric bushing 503 is slightly smaller than the inner diameter of the bushing hole. The eccentric bushing can rotate about the central axis of the outer cylindrical surface of the eccentric bushing in the bushing hole relative to the mounting block 502. Optionally, the eccentric bushing 503 also has a portion axially extending out of the mounting block 502 for connecting the other end of the connecting rod 516. Referring to FIG. 4, in an embodiment according to the present invention, the eccentric bushing may be rotatably fitted to the mounting block by a flange disposed at the axially extending portion and an opposite limiting block mounted at the other end of the eccentric bushing, to prevent the eccentric bushing from moving axially in the bushing hole and thus maintain the stability of its rotation.

One shaft end of the ink transfer roller 512 is rotatably mounted in the eccentric bushing 503 through a bearing. The central axis of the ink transfer roller 512 is collinear with the central axis of the inner cylindrical surface of the eccentric bushing 503. Since the central axis of the outer cylindrical surface of the eccentric bushing 503 is not collinear with the central axis of the inner cylindrical surface, the position of the inner cylindrical surface of the eccentric bushing changes correspondingly when the eccentric bushing rotates in the bushing hole. Accordingly, the position of the shaft end of the ink transfer roller 512 in the eccentric bushing 503 also changes, and the position of the central axis of the ink transfer roller 512 changes, resulting in the change in the distance between the ink transfer roller 512 and the anilox roller 511. This causes the pressure between the two to change. When the eccentric bushing is rotated to move the ink transfer roller 512 to a pressing position, the distance between the ink transfer roller 512 and the anilox roller 511 is reduced, and the two are pressed together, thereby generating a pressure with which the ink transfer roller 512 presses against the anilox roller 511. When the eccentric bushing is rotated to move the ink transfer roller 512 to a rest position, the distance between the ink transfer roller 512 and the anilox roller 511 is increased, and the two are released from being pressed (with or without contact), and the ink transfer roller 512 will not provide a pressure to the anilox roller 511.

During operation, the ink transfer roller 512 can be moved to different pressing positions by rotating the eccentric bushing by the pressure applicator member as needed. The ink transfer roller is moved to a different pressing position by rotating the eccentric bushing 503. Due to the eccentric structure of the eccentric bushing, the distance between the ink transfer roller 512 and the anilox roller 511 can be adjusted, thereby adjusting the generated pressure with which the ink transfer roller 512 presses against the anilox roller 511. Moreover, due to the flexibility, resilience and low hardness of the rubber, the deformation of the ink transfer roller 512 can be finely controlled by adjusting the pressure generated. Therefore, for the registration of dyeing, the registration accuracy can be further adjusted by adjusting the pressure applied.

Preferably, in order to uniformly apply pressure to the anilox roller 511 by the whole ink transfer roller 512 in the length direction, the other shaft end side of the ink transfer roller 512 is also provided with an additional same pressure applicator member. More preferably, the actuator on the other shaft end side of the ink transfer roller 512 can be omitted, and only the swing arm, the connecting rod and the eccentric bushing are provided. That is, the two pressure applicator members share the actuator 509. The two swing arms on the two shaft end sides of the ink transfer roller 512 are non-rotatably fixed to the swing arm pivot shaft 504, whereby the two swing arms are pivoted synchronously by means of the swing arm pivot shaft 504, thereby realizing the synchronous movement of the two connecting rods and eccentric bushings.

The eccentric bushing can be set to be initially located at the rest position. When a pressure is applied, the actuator 509 is actuated to cause the piston rod to extend and drive the swing arm 508 to pivot about the central axis of the swing arm pivot shaft 504, thereby causing the connecting rod 516 coupled to the swing arm 508 to move. The movement of the connecting rod 516 in turn drives the eccentric bushing to rotate, and the rotation of the eccentric bushing 503 moves the ink transfer roller 512 to a pressing position (refer to FIG. 4). The distance between the ink transfer roller 512 and the anilox roller 511 is reduced, and the two are pressed together, thereby providing a pressure with which the ink transfer roller 512 presses against the anilox roller 511. On the contrary, when no pressure is needed to be applied, the actuator 509 is actuated to withdraw the piston rod and drive the swing arm 508 to pivot about the central axis of the swing arm pivot shaft 504, thereby causing the connecting rod 516 coupled to the swing arm pivot shaft 504 to move. The movement of the connecting rod 516 in turn drives the eccentric bushing 503 to rotate, and the rotation of the eccentric bushing 503 moves the ink transfer roller 512 to a rest position. The distance between the ink transfer roller 512 and the anilox roller 511 is increased, and the two are released from being pressed together, whereby no pressure is applied by the ink transfer roller 512 to the anilox roller 511. The traveling distance of the piston rod of the actuator 509 can be set to 80-200 mm, preferably 100 mm.

The axes of the central roller 1, the ink transfer roller 512, and the anilox roller 511 are parallel. Preferably, the axes of the three may not be coplanar. It can be seen from the schematic views shown in FIGS. 3 and 4 that the axes of the three are not collinear, and preferably, the axial connection of the three forms an angle ranging from 130 to 170 degrees, and preferably 146 or 147 degrees. In addition, it can also be seen from the schematic view of FIG. 4 that the swing arm pivot shaft 504 is arranged substantially on one side of the anilox roller 511 opposing the side where the ink transfer roller resides. That is, the axes of the anilox roller 511, the ink transfer roller 512, and the swing arm pivot shaft 504 are arranged to form a triangle. The advantage of such an arrangement is that the size of the dyeing deployment device in the direction perpendicular to the axis of the central roller 1 can be reduced, such that the frame and the mounting block are compact in structure; and also the parts can be maintained and replaced easily.

Figure 6:
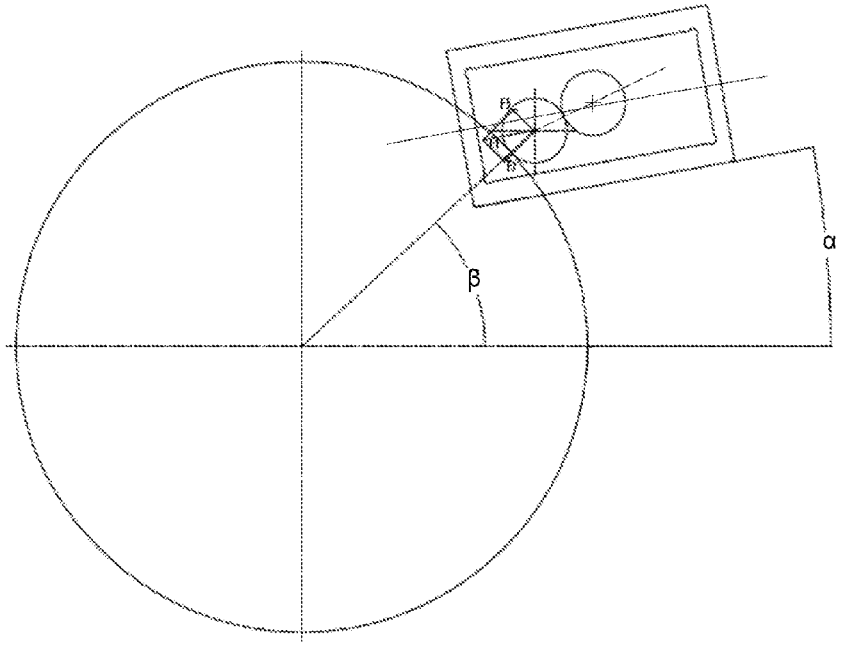
FIG. 6 is a schematic illustration showing the force and positional relationship between an individual dyeing deployment device and a central roller according to the present invention.

Moreover, as shown in FIG. 6, when the mounting block 502 is moved toward the central roller 1 under the action of the propulsion cylinder 506, the direction of the pushing pressure F1 of the ink transfer roller 512 pressing against the central roller 1 is parallel to the length direction of the slide rail, that is, parallel to the longitudinal centerline of the dyeing deployment device. The pushing pressure F1 can be decomposed into a vertical and a tangential component. The vertical component refers to the actual dyeing pressure F2 perpendicular to the circumferential outer surface of the central roller, that is, toward the center of the central roller, and the magnitude of the dyeing pressure is expressed as the amount of rubber deformation of the rubber roller. The tangential component is a tangential pressure F3 that is tangential to the circumferential outer surface of the central roller. The tangential pressure F3 has an impact on the tangential deformation of the rubber coating layer of the roller, but has little impact on the deformation of the dyeing pattern. For the same batch of dyeing operations, the required dyeing pressure F2 should remain the same, so in the case where the angle β between the connection line of the centers of the ink transfer roller-central roller and the horizontal line is definite, the magnitudes of the pushing pressure F1 and the tangential pressure F3 is a function of the angle α between the longitudinal centerline of the dyeing deployment device and the horizontal line. The smaller the angle α is, the larger the pushing pressure F1 and the tangential pressure F3 will be; otherwise, the larger the angle α is, the smaller the pushing pressure F1 and the tangential pressure F3 will be. By providing the tangential pressure F3, the tangential deformation of the rubber coating layer of the roller can be controlled.

In an embodiment, the angle α between the longitudinal centerline of the dyeing deployment device and the horizontal line may be 0-90 degrees, and preferably 15 degrees. The angle between the connection line of the centers of the anilox roller-ink transfer roller and the longitudinal centerline of the dyeing deployment device may be 4-35 degrees, and preferably 23 degrees.

Preferably, the dyeing deployment device may further include a pressure locker 517 for locking the pressure between the ink transfer roller 512 and the anilox roller 511 to avoid slight fluctuation of the pressure value due to unevenness of the surface of the fabric 2 during production. The pressure locker can include a member of variable length that is pivotally coupled to the eccentric bushing 503 at one end and pivotally secured to the mounting block 502 at the other end. The length of the member changes as the eccentric bushing 503 rotates. When the pressure of the ink transfer roller 512 pressing against the anilox roller 511 is adjusted to a desired value by the actuator 509 as needed, the operator can lock the pressure locker 517 by any suitable means, thereby making the length of the member of variable length constant. In this way, the pressure of the ink transfer roller 512 pressing against the anilox roller 511 is kept constant.

The transfer dyeing apparatus according to the present invention achieves good results in the productivity and product quality in production application of transfer dyed products. Each dyeing deployment device can be independently brought into contact with the central roller under pressure or detached from the central roller by means of respective propulsion device, so that other dyeing deployment devices continue to perform transfer dyeing and the pressure pressing against the central roller can be independently adjusted. The ink transfer roller is used as a temporary transfer carrier, and the consumption of consumables such as paper is avoided, thus reducing the operating costs. Moreover, the present method is environmentally friendly, economical and practical. In addition, the transfer dyeing apparatus of the present invention can realize high-speed transfer dyeing production, and the dyeing speed can be as high as 30-60 m/min.

Double-sided dyeing can share a single drying unit 1000 or two separate drying units may be provided.

The dyeing unit 100 that dyes the first side and the dyeing unit 100' that dyes the opposite second side may be of different colors, so that double-sided different-color dyeing can be achieved. This cannot be accomplished with traditional dyeing processes.

In addition, the pressure applicator members provided in the two dyeing units can adjustably provide the pressure with which the ink transfer roller presses against the anilox roller, so that the present invention is adapted to different fabric properties and fabric thickness, to effectively control the dyeing effect.

Although the present invention has been illustrated and described with reference to the specific exemplary embodiments, the present invention is not limited thereto. It will be appreciated that variations and modifications can be made to these exemplary embodiments by those skilled in the art without departing from the scope and spirit of the invention as defined by the appended claims.

What is claimed is:

1. A transfer dyeing method, comprising the following steps:

1) uniformly coating a pretreating liquid on a front side of a fabric by a first pretreating anilox roller, to form a fabric having a front side with a wet surface layer;
2) printing a dyeing ink on a first ink transfer roller or ink transfer ribbon by a first full-master printing plate roller;
3) pressing the fabric having a front side with a wet surface layer obtained in Step 1 tightly to the first ink transfer roller or ink transfer ribbon obtained in Step 2, to allow them to be in contact with each other under pressure, and transfer the dyeing ink from the first ink transfer roller/ink transfer ribbon to the front side of the fabric, so as to realize dyeing on the front side of the fabric;
4) drying the fabric and then making a back side of the fabric face to a second pretreating anilox roller;
5) then uniformly coating the pretreating liquid on the back side of the fabric by the second pretreating anilox roller, to form a fabric having a back side with a wet surface layer;
6) printing a dyeing ink that is the same as or different from the dyeing ink in Step 2 on a second ink transfer roller or ink transfer ribbon by a second full-master printing plate roller, according to the dyeing requirement of the double-sided same color or double-sided different colors;
7) pressing the fabric having a back side with a wet surface layer obtained in Step 5 tightly to the second ink transfer roller or ink transfer ribbon obtained in Step 6, to allow them to be in contact with each other under pressure, and transfer the dyeing ink from the second ink transfer roller/ink transfer ribbon to the back side of the fabric, so as to realize dyeing on the back side of the fabric; and
8) drying the fabric, followed by color fixing, water washing and shaping, to obtain a dyed end product.

2. The transfer dyeing method according to claim 1, wherein the formulation of the pretreating liquid comprises, in percentages by weight:

vehicle, 2-10%;
surfactant, 1-3%;
leveling agent, 1-4%;
dye fixing agent, 0-25%;
pH adjusting agent, 0-2%; and
deionized water, q.s. to 100%, wherein the vehicle is sodium alginate, guar gum, synthetic gum tragacanth, cellulose and a derivative thereof, starch and a derivative thereof, or a polymer of acrylic acid, butenoic acid and a derivative thereof;

the surfactant is polyvinylpyrrolidone, polyoxyethylene alkylamines, fatty alcohol-polyoxyethylene ethers, or polysiloxane;

the leveling agent is sodium alkyl sulfonate, sodium higher fatty alcohol sulfate, or fatty alcohol-polyoxyethylene;

wherein the dyeing ink is an active dyeing ink for cotton dyeing, or an acid dyeing ink for nylon dyeing, or a disperse dyeing ink for polyester dyeing;

the dye fixing agent in the pretreating liquid for the active dyeing ink is sodium carbonate, sodium bicarbonate, sodium hydroxide, potassium carbonate, potassium bicarbonate, potassium hydroxide, or substitute alkali; the dye fixing agent in the pretreating liquid for the acid dyeing ink is urea, or dicyandiamide; and no dye fixing agent is added in the dye fixing agent in the pretreating liquid for the disperse dyeing inks; and the pH adjusting agent is citric acid, acetic acid, ammonium sulfate, or triethanol amine.

3. The transfer dyeing method according to claim 1, wherein the first anilox roller and the second anilox roller each are a laser engraved chromium-plated anilox roller or ceramic anilox roller having a line number of 60-200 lines/cm.

4. The transfer dyeing method according to claim 1, wherein the first full-master printing plate roller and the second full-master printing plate roller are selected from a group consisting of a gravure plate roller, a flexographic plate roller, a rotary screen and an offset plate roller.

5. The transfer dyeing method according to claim 1, wherein the first ink transfer roller or ink transfer ribbon and the second ink transfer roller or ink transfer ribbon have a surface made of a rubber coating with a thickness of 3-15 mm and a surface hardness of 45-90 Shore degrees, where the rubber is polyurethane rubber, acrylonitrile-butadiene rubber, neoprene rubber, chlorosulfonated polyethylene rubber, or ethylene-propylene rubber.

6. The transfer dyeing method according to claim 1, wherein the color fixing in Step 8 is cold dome color fixing, steaming fixation, or baking fixation.

7. The transfer dyeing method according to claim 1, wherein the first pretreating anilox roller and the second pretreating anilox roller are the same pretreating anilox roller.

8. The transfer dyeing method according to claim 1, wherein Steps 2,3,6, and 7 are performed in a dyeing unit of a dyeing apparatus, the dyeing unit comprising: a central roller mounted on a frame; and at least one dyeing deployment device arranged around the circumference of the central roller, wherein a fabric to be dyed enters and is dyed between the central roller and each dyeing deployment device, wherein each dyeing deployment device comprises the full-master printing plate roller carrying full master of dyeing ink and the ink transfer roller for transferring the dyeing ink on the full-master printing plate roller to the fabric, and the ink transfer roller is located between the full-master printing plate roller and the central roller, and the axes of the ink transfer roller, the printing plate roller, and the central roller are parallel to each other, but are not coplanar.

9. The transfer dyeing method according to claim 8, wherein the outer diameter of the printing plate roller<the outer diameter of the ink transfer roller≤the outer diameter of the printing plate roller+1 mm.

10. The transfer dyeing method according to claim 8, wherein each dyeing deployment device further comprises a pressure applicator member configured to adjustably provide a pressure to the ink transfer roller pressing against the printing plate roller, wherein the pressure applicator member is capable of selectively moving the ink transfer roller to a pressing position and a rest position; at the pressing position, the ink transfer roller presses against the printing plate roller to generate a pressure with which the transfer roller presses against the printing plate roller; and at the rest position, the ink transfer roller does not press against the printing plate roller.

11. The transfer dyeing method according to claim 10, wherein the pressure applicator member comprises a rotatable eccentric bushing, a shaft end of the ink transfer roller is rotatably mounted in the eccentric bushing, and the distance between the ink transfer roller and the printing plate roller is capable of being adjusted by rotating the eccentric bushing, thereby adjusting the generated pressure with which the ink transfer roller presses against the printing plate roller.

12. The transfer dyeing method according to claim 11, wherein the ink transfer roller is selectively moved to multiple pressing positions by rotating the eccentric bushing.

13. The transfer dyeing method according to claim 11, wherein the pressure applicator member further comprises a connecting rod for driving the eccentric bushing to rotate and a swing arm for moving the connecting rod, one end of the connecting rod being connected to the eccentric bushing, the other end of the connecting rod being connected to the swing arm, and the swing arm being pivotable relative to the body of the dyeing deployment device by means of a the swing arm pivot shaft.

14. The transfer dyeing method according to claim 13, wherein the pressure applicator member further comprises an actuator, the actuator driving the swing arm to pivot, and the pivoting of the swing arm causing the connecting rode to drive the eccentric bushing to rotate, thereby moving the ink transfer roller to the pressing position or the rest position.

15. The transfer dyeing method according to claim 10, wherein one pressure applicator member is provided on each of the two shaft end sides of the ink transfer roller.

16. The transfer dyeing method according to claim 13, wherein one pressure applicator member is provided on each of the two shaft end sides of the ink transfer roller, and the swing arm on one shaft end side and the swing arm on the other shaft end side are pivoted synchronously by the same swing arm pivot shaft, to achieve the synchronous movement of the two connecting rods and eccentric bushings, thereby maintaining the synchronous pressure application on the two shaft ends of the printing plate roller; and only one of the pressure applicator members on the two shaft end side of the ink transfer roller comprises an actuator for driving the swing arm to pivot.

17. The transfer dyeing method according to claim 13, wherein the swing arm comprises a first arm portion and a second arm portion, each arm portion comprising a first end and a second end, the first end of the first arm portion being pivotally coupled to a protrusion of the actuator by a pin, the first end of the second arm portion being pivotally coupled to the other end of the connecting rod by a pin, and the second ends of the two arm portions being non-rotatably fixed to the end portion of the swing arm pivot shaft.

18. The transfer dyeing method according to claim 8, wherein the central roller is a roller of hard material having a surface covered with a rubber and a cavity filled with an oil, wherein the roller of hard material controls the temperature of the central roller by heating the oil by an electrical heating bar provided in the cavity.

19. The transfer dyeing method according to claim 8, wherein each dyeing deployment device capable of independently advancing toward or going away from the central roller by means of respective propulsion device, and the transfer dyeing method further comprises a propulsion device for providing a propulsive force for advancing the ink transfer roller toward the central roller, the propulsion device being mounted on a frame of the dyeing deployment device; and each dyeing deployment device further comprises a pressure locker for locking the pressure between the ink transfer roller and the printing plate roller; and each dyeing deployment device further comprises a frame in which a slide rail is provided and a mounting block is disposed to be slidable on the slide rail, wherein the ink transfer roller and the printing plate roller are rotatably mounted into the mounting block, and the mounting block is capable of moving in the frame towards the central roller with the propulsion of the propulsion device.

20. The transfer dyeing method according to claim 19, wherein the propulsion device also provides an independently adjustable pressure that allows the ink transfer roller to press against the fabric to be dyed on the central roller.

* * * * *